US009484717B2

(12) United States Patent
Strong et al.

(10) Patent No.: US 9,484,717 B2
(45) Date of Patent: Nov. 1, 2016

(54) HIGH ENERGY IGNITION SPARK IGNITER

(71) Applicant: John Zink Company, LLC, Tulsa, OK (US)

(72) Inventors: Andrew H. Strong, Norwich, NY (US); Ewen M. Kelly, Norwich, NY (US)

(73) Assignee: Chentronics, LLC, Norwich, NY (US)

( * ) Notice: Subject to any disclaimer, the term of this patent is extended or adjusted under 35 U.S.C. 154(b) by 0 days.

(21) Appl. No.: 14/566,551

(22) Filed: Dec. 10, 2014

(65) Prior Publication Data

US 2015/0188292 A1 Jul. 2, 2015

Related U.S. Application Data

(60) Provisional application No. 61/920,812, filed on Dec. 26, 2013.

(51) Int. Cl.

| | |
|---|---|
| ***F23Q 3/00*** | (2006.01) |
| ***H01T 13/02*** | (2006.01) |
| ***H01T 1/22*** | (2006.01) |
| ***H01T 13/20*** | (2006.01) |
| ***H01T 13/52*** | (2006.01) |

(52) U.S. Cl.

CPC . *H01T 1/22* (2013.01); *F23Q 3/00* (2013.01); *F23Q 3/004* (2013.01); *H01T 13/20* (2013.01); *H01T 13/52* (2013.01)

(58) Field of Classification Search

CPC ..... H01T 1/22; H01T 13/52; H01T 13/20; F23Q 3/00

USPC ..... 313/130; 431/264

See application file for complete search history.

(56) References Cited

U.S. PATENT DOCUMENTS

| | | | | |
|---|---|---|---|---|
| 2,064,089 | A | 12/1936 | Stemmeler | |
| 2,129,576 | A | 9/1938 | Gorny et al. | |
| 2,214,958 | A | 9/1940 | Gotterba et al. | |
| 2,332,210 | A | 10/1943 | Frank | |
| 2,501,826 | A | 3/1950 | McCarthy et al. | |
| 2,906,922 | A | 9/1959 | Huber | |
| 2,953,704 | A * | 9/1960 | Harris | H01T 13/52 252/521.2 |
| 3,046,434 | A * | 7/1962 | Schurecht | H01B 1/00 313/131 R |
| 3,073,121 | A | 1/1963 | Baker et al. | |
| 3,312,848 | A | 4/1967 | Baum | |
| 3,558,959 | A * | 1/1971 | Ziemendorf | C04B 35/575 313/130 |
| 3,883,762 | A * | 5/1975 | Harris | H01T 13/52 313/130 |
| 4,136,259 | A | 1/1979 | Djeddah | |
| 4,142,121 | A * | 2/1979 | Carpenter | H01T 13/52 313/131 A |

(Continued)

FOREIGN PATENT DOCUMENTS

| | | |
|---|---|---|
| DE | 3841931 A1 | 6/1989 |
| EP | 0341807 A2 | 11/1989 |

(Continued)

OTHER PUBLICATIONS

Office Action issued Aug. 27, 2015 in corresponding European application No. 14199022.6, John Zink Company, L.L.C.

(Continued)

*Primary Examiner* — Donald Raleigh

(57) ABSTRACT

The disclosure pertains to ignition systems and more particularly to spark igniters for burners and burner pilots. The spark igniter provided, is configured such that an electric field concentration between two electrodes increases while keeping output voltage unchanged.

19 Claims, 9 Drawing Sheets

(56) References Cited

U.S. PATENT DOCUMENTS

| | | | | |
|---|---|---|---|---|
| 4,187,825 | A | 2/1980 | Loyd, Jr. | |
| 4,315,298 | A | 2/1982 | Mulkins et al. | |
| 4,695,758 | A | 9/1987 | Nishida et al. | |
| 4,711,629 | A | 12/1987 | MacDonald | |
| 4,951,173 | A | 8/1990 | Suzuki et al. | |
| 5,074,262 | A | 12/1991 | McAbee et al. | |
| 5,103,136 | A * | 4/1992 | Suzuki | H01T 13/52 313/131 A |
| 6,048,196 | A | 4/2000 | Collier et al. | |
| 6,495,948 | B1 | 12/2002 | Garrett, III | |
| 7,699,602 | B2 * | 4/2010 | Boatwright | C03B 40/027 431/132 |
| 8,796,909 | B2 * | 8/2014 | Hasegawa | H01T 13/16 313/120 |
| 2005/0189858 | A1 * | 9/2005 | Chang | H01T 13/34 313/141 |
| 2011/0146227 | A1 * | 6/2011 | Mee | H01T 13/465 60/39.821 |
| 2011/0215703 | A1 | 9/2011 | Maul et al. | |
| 2014/0292177 | A1 * | 10/2014 | Nagy | H01T 13/20 313/141 |

FOREIGN PATENT DOCUMENTS

| | | | | |
|---|---|---|---|---|
| EP | 1202411 | A1 | 5/2002 | |
| GB | 545351 | | 5/1942 | |
| GB | 745016 | | 2/1956 | |
| GB | 819256 | | 9/1959 | |
| GB | 848070 | | 9/1960 | |
| GB | 855440 | | 11/1960 | |
| GB | 1146244 | | 3/1969 | |
| GB | 1146244 | A * | 3/1969 | H01T 13/52 |
| GB | 2157816 | A | 10/1985 | |
| GB | 2361264 | A | 10/2001 | |
| JP | 61-032979 | A | 2/1986 | |
| JP | 01-163986 | A | 6/1989 | |
| JP | 2002-506278 | A | 2/2002 | |
| WO | 9927303 | | 6/1999 | |
| WO | 9945615 | | 9/1999 | |
| WO | 0215349 | A1 | 2/2002 | |

OTHER PUBLICATIONS

Office Action issued Jan. 19, 2016 in corresponding Japanese application No. 2014-262128, John Zink Company, L.L.C.

Office Action issued Feb. 19, 2016 in corresponding Canadian application No. 2,875,267, John Zink Company, L.L.C.

Search Report and Written Opinion issued Mar. 20, 2015 in corresponding Singapore application No. 10201408452U, John Zink Company, L.L.C.

Office Action issued May 16, 2016 in corresponding Korean application No. 10-2014-0190379.

* cited by examiner

HIGH ENERGY IGNITION SPARK IGNITER

CROSS-REFERENCE TO RELATED APPLICATION

This application claims the benefit of U.S. Provisional Application No. 61/920,812 filed Dec. 26, 2013, which is hereby incorporated by reference.

FIELD OF INVENTION

The present application relates to ignition systems and more specifically to spark igniters for burners and burner pilots.

BACKGROUND

A gas burner pilot is a device used to create a stable pilot flame by combustion of a low flow rate (relative to the main burner) gaseous fuel-air mixture. The pilot flame is used to ignite a larger main burner, or a difficult to ignite fuel. Gas pilot designs normally include an ignition system. One common type of ignition system used in gas burner pilots, as well as other burner systems such as flare systems, is a High-Energy Ignition (HEI) system.

HEI systems are used in industry for their ability to reliably ignite light or heavy fuels in cold, wet, dirty, contaminated igniter plug, or other adverse burner startup conditions. An HEI system typically utilizes a capacitive discharge exciter to pass large current pulses to a specialized spark (electric arc) igniter. These systems are typically characterized by capacitive storage energies in the range of 1 J to 20 J and the large current impulses generated are often greater than 1 kA. The spark igniter (also known as a spark plug, spark rod or igniter probe) of an HEI system is generally constructed using a cylindrical center electrode surrounded by an insulator and an outer conducting shell over the insulator such that, at the axially-facing sparking end of the spark rod, an annular ring air gap is formed on the surface of the insulator between the center electrode and the outer conducting shell. At this air gap, also called a spark gap, an HEI spark can pass current between the center electrode and outer conducting shell. Often a semiconductor material is applied to the insulating material at this gap to facilitate sparking. In general, the spark energy of an HEI system is significantly greater than the required Minimum Ignition Energy of a given fuel, given that the appropriate fuel to air ratio and mix present. This extra energy allows the ignition system to create powerful sparks which will be minimally affected by the adverse burner startup conditions mentioned above.

For cost and size considerations it is desirable to minimize the output energy of an HEI system, however, as output energy is decreased it becomes increasingly more difficult to create sparks in adverse burner startup conditions.

SUMMARY

In accordance with one embodiment of the present disclosure, there is provided a spark igniter comprising a plurality of electrodes and an insulator, which are configured to form a body having an outer surface. The plurality of electrodes comprises a center electrode and a shell electrode. The center electrode has an inner surface, an end and at least a portion of the center electrode forms at least part of the body's outer surface.

The shell electrode also has an inner surface, an end and at least a portion of the shell electrode forms at least part of the body's outer surface. The insulator is between the center electrode and the shell electrode and at least a portion of the insulator is uncovered by the center electrode and the shell electrode. A chamfered portion of the insulator is adjacent to the uncovered portion of the insulator. This chamfered portion mates with a chamfered potion of the inner surface of the center electrode and with a chamfered portion of the inner surface of the shell electrode such that the center electrode and the shell electrode are positioned and electrically insulated from each other such that a spark gap is formed from a first edge of the center electrode and a second edge of the shell electrode.

In accordance with another embodiment of the present disclosure, there is provided a spark igniter comprising a plurality of electrodes and an insulator, which are configured to form a body having an outer surface. The plurality of electrodes comprises a center electrode and a shell electrode. The center electrode has an inner surface, an end and at least a portion of the center electrode forms at least part of the body's outer surface. The shell electrode also has an inner surface, an end and at least a portion of the shell electrode forms at least part of the body's outer surface. The insulator is between the center electrode and the shell electrode and at least a portion of the insulator is uncovered by the center electrode and the shell electrode such that the center electrode and the shell electrode are positioned and electrically insulated from each other such that a spark gap is formed from a first edge of the center electrode and a second edge of the shell electrode. At least one of the first edge and the second edge of the spark gap has a non-uniform geometric shape.

In accordance with yet another embodiment of the present disclosure, there is a spark igniter comprising a plurality of electrodes and an insulator, which are configured to form a body having an outer surface. The plurality of electrodes comprises a center electrode and a shell electrode. The center electrode has an inner surface, an end and at least a portion of the center electrode forms at least part of the body's outer surface. The shell electrode also has an inner surface, an end and at least a portion of the shell electrode forms at least part of the body's outer surface. The insulator is between the center electrode and the shell electrode and at least a portion of the insulator is uncovered from the center electrode and the shell electrode such that the center electrode and the shell electrode are positioned and electrically insulated from each other such that a spark gap is formed from a first edge of the center electrode and a second edge of the shell electrode. The depth of the spark gap is measured from the uncovered portion of the insulator to the body's outer surface of the body and wherein the depth is less than 8% of the outer surface perimeter of the body.

DETAILED DESCRIPTION

Figure 1A:
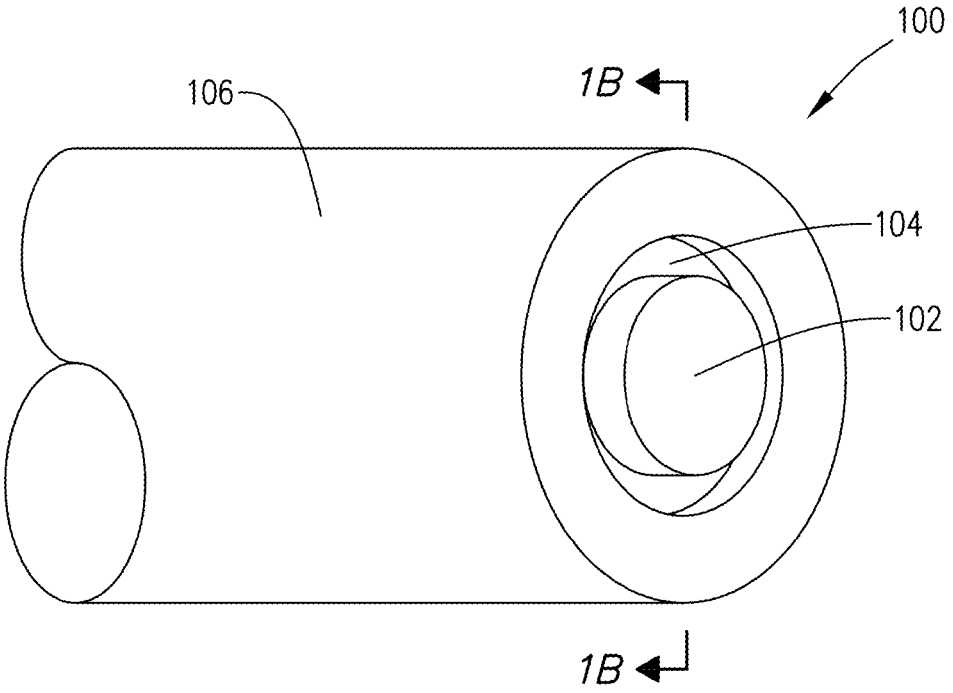
FIG. 1A PRIOR ART
FIG. 1A shows a perspective view of a prior art axially-directed spark igniter.

The description below and the figures illustrate a spark igniter of the type used in a furnace having a main burner that supplies a fuel and air mixture. While the present disclosure is described in the context of a spark igniter for a furnace, it will be appreciated that the presently disclosed spark igniter is more broadly applicable as an ignition system for fuels and can be applied to other systems.

A number of igniter geometry embodiments have been developed that allow an HEI system to minimize its output energy while keeping its output voltage unchanged and continuing to maintain its performance advantages in adverse conditions.

It has been discovered that the electric field concentration across the air gap between the two electrodes, specifically, the center electrode and shell electrode, can be increased by decreasing the well depth of the igniter tip to produce a flush or "nearly flush" surface gap between the shell electrode, the center electrode and the inner ceramic insulator. Among other advantages, this limits the total volume of contaminates that may pool or rest upon the surface gap of an igniter.

Another embodiment to increase the electric field concentration between the two electrodes is to apply internal chamfers to the shell electrode, the center electrode and/or the inner ceramic insulator. Among other advantages, these chamfers allow for better contact between mating parts and, thus, decrease the chance of a liquid penetrating between mating surfaces. In addition, another embodiment is to create a non-uniform electrode perimeter.

In still another embodiment that allows an HEI system to minimize its output energy while keeping its output voltage unchanged, is to increase the current density across a semiconductor. This can be accomplished by having a striped or partial semiconductor profile, by reducing the size of the center electrode or by reducing the outer diameter (OD) of the insulator.

The embodiments mentioned below are believed to function as stand-alone improvements as well as used in conjunction therewith. They may also be applied to end-fired or side-fired igniter geometries unless otherwise noted. An end-fired igniter has a geometry such that the igniter tip is located on an axial facing surface. A side-fired igniter has a geometry such that the igniter tip is located on a radial facing surface.

Increase the electric field concentration between the two electrodes. Sharp points or edges on the charged electrodes create an electric field concentration that is greater on the points and edges than that of a non-sharp or uniform electrode surface. This can be accomplished as follows:

Decrease the well depth of the igniter tip. This effectively creates an electrode profile (relative to a plane perpendicular to the radial direction) that contains nearly sharp edges. Decreasing the well depth can also decrease the ability of contaminants to build up in the air gap.

Internal chamfers on the shell electrode. The center electrode and/or the inner ceramic insulator can be applied so as to also create an electrode profile (again relative to a plane perpendicular to the radial direction) that contains nearly-sharp edges.

A non-uniform electrode perimeter. This effectively creates an electrode profile (relative to a plane perpendicular to the axial direction) that contains nearly sharp edges. Increase the current density across the semiconductor. Current density is the electric current per unit area of the semiconductor. A higher density increases an igniter's ability to achieve an arc. If the current is held to a constant value, then any decrease in the area of the semiconductor will increase the current density. This can be accomplished as follows:

- A striped or partial semiconductor profile. This directly decreases the surface area of the semiconductor.
- Decrease the well depth of the igniter tip. Ionized water pooling in the igniter well acts as a conductive path through which current can flow. The addition of the water effectively increases the conductive area and therefore decreases the current density. By minimizing the amount of water that can pool in an air gap, the deleterious effects on current density can be minimized.
- Reduce the size of the center electrode. With air gap and shell electrode OD being held constant, this directly decreases the surface area of the semiconductor. This mainly applies to end-fired igniters.
- Reduce the outer diameter (OD) of the insulator. This directly decreases the surface area of the semiconductor with the air gap and electrode ODs being held constant. This mainly applies to side-fired igniters.

In other words, the description below and the figures illustrate a spark igniter of the type used in a furnace having a main burner that supplies a fuel and air mixture. While the present disclosure is described in the context of a spark igniter for a furnace, it will be appreciated that the presently disclosed spark igniter is more broadly applicable as an ignition system for fuels and can be applied to other systems.

Figure 1B:
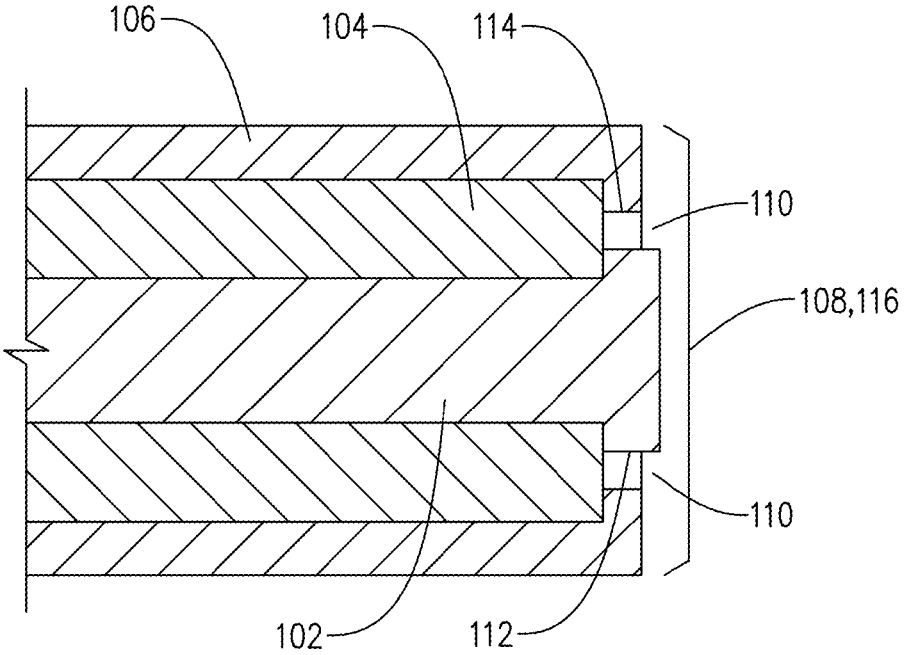
FIG. 1B PRIOR ART
FIG. 1B shows a cross-sectional view of a prior art axially-directed spark igniter.

Referring now to FIGS. 1A-B, a prior art axially-directed spark igniter 100 is illustrated. Spark igniter 100 has a center electrode 102 surrounded by an insulator 104 and an outer conducting shell or shell electrode 106 over the insulator such that, at the igniter tip 108, a spark gap 110 is formed between the center electrode 102 and the shell electrode 106, i.e., a gap between the center electrode and the outer electrode shell. Often a semiconductor material is applied to the insulating material at this gap to facilitate sparking. At this spark gap 110, a high-energy spark can pass between a first edge 112 of the center electrode 102 and a second edge 114 of the shell electrode 106.

As can be seen from FIG. 1B, spark gap 110 is located on the end surface or axial-facing surface 116 of the igniter tip 108. Accordingly, spark igniter 100 produces an axially-directed spark, i.e., a spark directed along the longitudinal axis of the spark igniter at and away from the axial-facing surface 116. The spark ignites fuel.

Figure 2A:
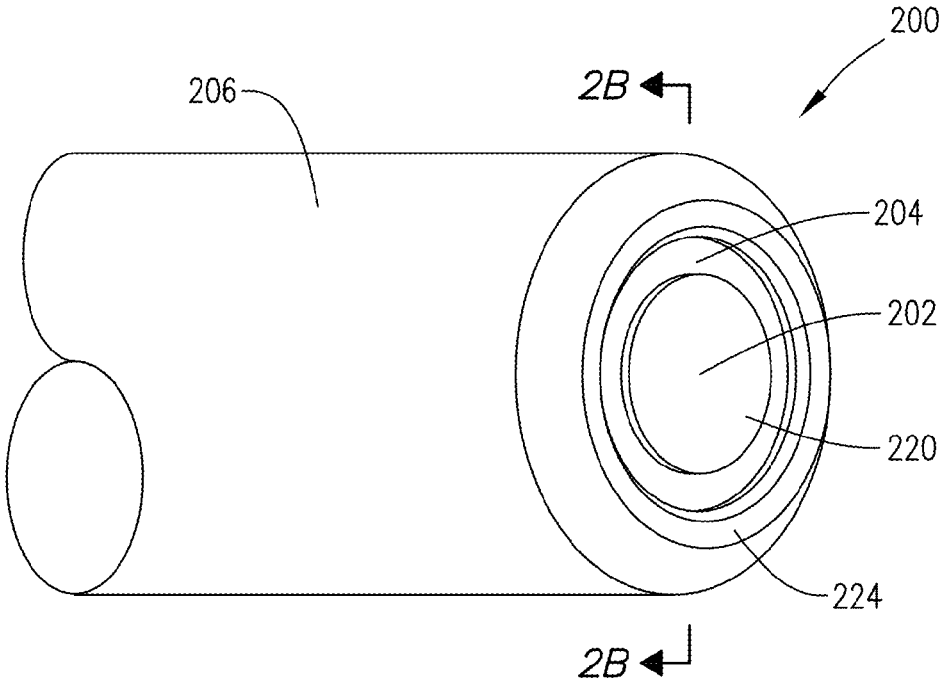
FIG. 2A shows a perspective view of an axially-directed spark igniter that may be used in accordance with certain embodiments of the present disclosure.
Figure 2B:
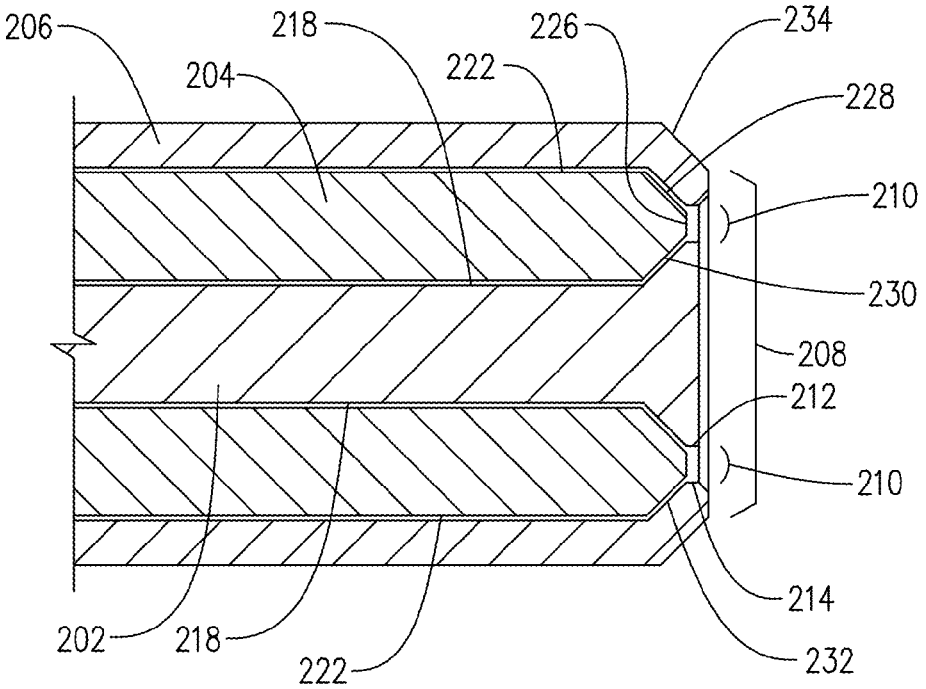
FIG. 2B shows a cross-sectional view of an axially-directed spark igniter that may be used in accordance with certain embodiments of the present disclosure.

FIGS. 2A-B depict an axially-directed spark igniter 200 in accordance with certain embodiments of the invention. Spark igniter 200 allows an HEI system to minimize its output energy while keeping its output voltage unchanged and continuing to maintain its performance in adverse conditions. Spark igniter 200 has a plurality of electrodes and an insulator 204 that forms a body. The plurality of electrodes comprises a center electrode 202 and a shell electrode 206. The center electrode 202 has an inner surface 218, an end 220 and at least a portion of the center electrode forms at least part of the body's outer surface. The shell electrode 206 also has an inner surface 222, an end 224 and at least a portion of the shell electrode forms at least part of the body's outer surface. The insulator 204 is between the center electrode 202 and the shell electrode 206 and at least a portion of the insulator is uncovered 226 by the center electrode and the shell electrode such that the center electrode and the shell electrode are positioned and electrically insulated from each other such that a spark gap 210 is formed at the igniter tip 208 from a first edge of the center electrode 212 and a second edge of the shell electrode 214. The depth of the spark gap 210, or in other words well depth, is measured from the uncovered portion 226 of the insulator to the outer surface of the body adjacent to the spark gap 210. The outer surface of the body adjacent to the spark gap 210 on an axially-directed igniter is the outermost of either the end of the center electrode 220 or the end of the shell electrode 224.

FIGS. 2A-B depict an embodiment of the present disclosure that will increase the electric field concentration between the two electrodes by applying internal chamfers to the shell electrode, the center electrode and/or the insulator. As shown in FIG. 2B, a portion of the insulator 204 adjacent to the uncovered portion 226 of the insulator extends to a chamfered portion 228. This chamfered portion 228 mates with a chamfered portion 230 of the inner surface 218 of the center electrode 202 and with a chamfered portion 232 of the inner surface 222 of the shell electrode 206. A spark gap 210 is formed from first edge 212 of the center electrode 202 and second edge 214 of the shell electrode 206. Center electrode 202 and shell electrode 206 are electrically insulated from each other at spark gap 210. Additionally, the outer surface of shell electrode 206 and the outer surface of center electrode 202 can be chamfered at the spark gap 210. This outer surface chamfering is illustrated by chamfer 234 on the outer surface of shell electrode 206.

As shown in FIGS. 2A-B, the chamfers create an electrode profile that contain angled edges that can be nearly-sharp, thereby increasing the electric field concentration between the shell electrode and center electrode. Among other advantages, these chamfers allow for better contact between mating parts and, thus, decrease the chance of a liquid penetrating between mating surfaces.

The embodiment depicted by FIGS. 2A-B, illustrate a decreased well depth over prior art igniter tips. The shallower well depth increases the electric field concentration between the two electrodes to produce a flush or "nearly flush" air gap between the shell electrode, the center electrode and the insulator. This effectively creates an electrode profile (relative to a plane perpendicular to the radial direction) that contains nearly sharp edges. Among other advantages, this limits the total volume of contaminates that may pool or rest upon the air gap of an igniter. To obtain the desired electrode profile for an axially-directed spark igniter the depth must be less than or equal to 5% of the perimeter of the inner surface of the shell electrode measured at the second edge. The depth can also be less than or equal to 5% of the perimeter of the inner surface of the center electrode measured at the first edge.

Figure 3A:
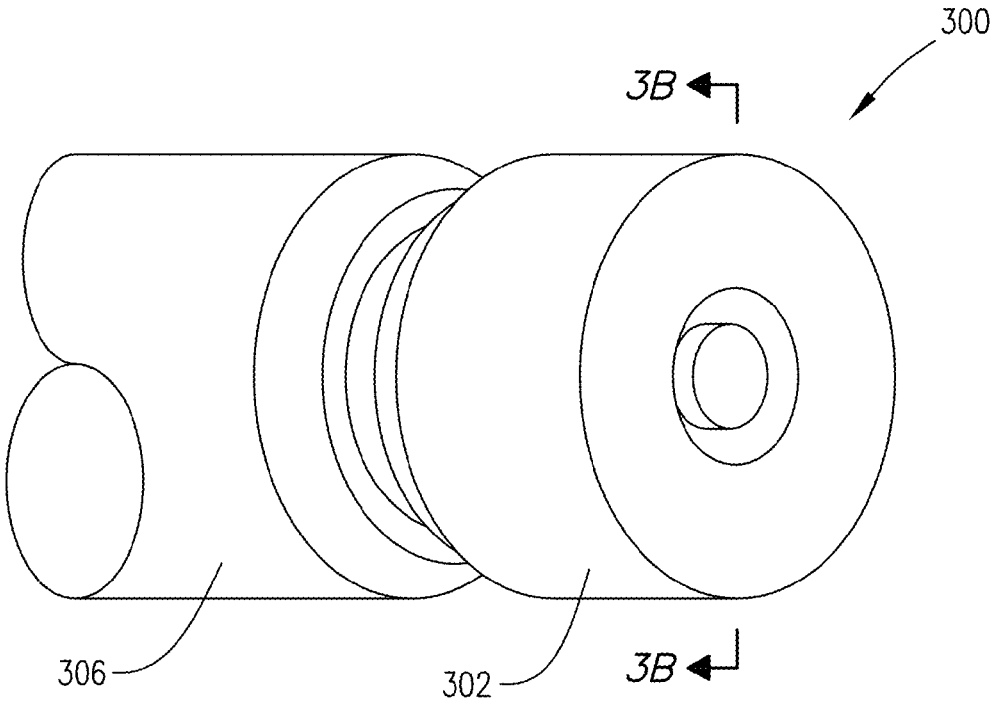
FIG. 3A shows a perspective view of a radially-directed spark igniter.
Figure 3B:
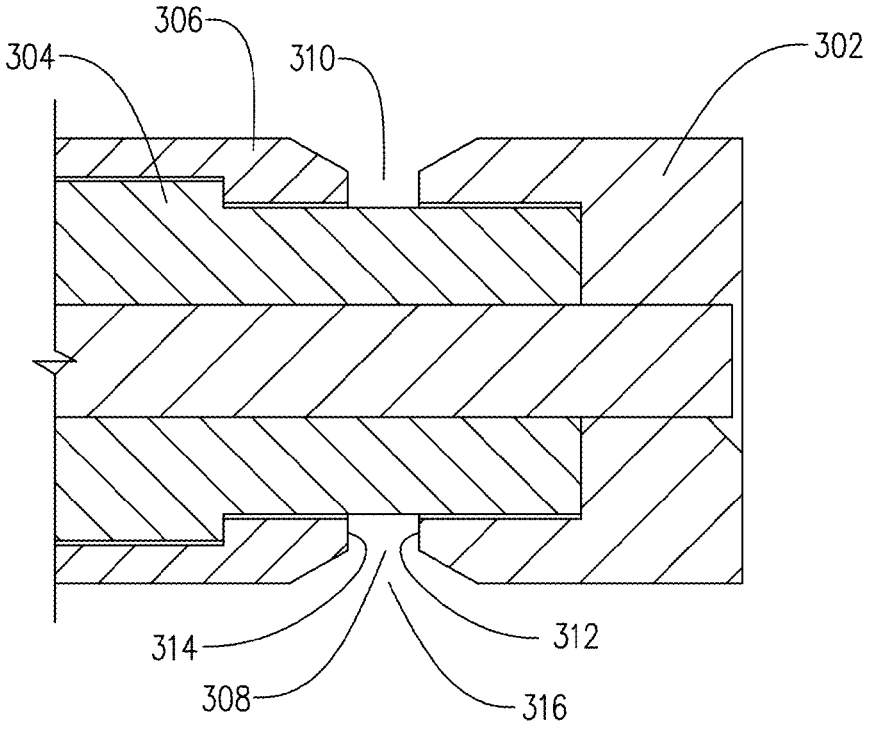
FIG. 3B shows a cross-sectional view of a radially-directed spark igniter.

FIGS. 3A-B, illustrate a radially-directed spark igniter 300 having a design in accordance with more traditional gap designs. Spark igniter 300 has a center electrode 302 surrounded by an insulator 304 and an outer conducting shell or shell electrode 306 over the insulator such that, at the igniter tip 308, spark gap 310 is formed between the center electrode 302 and the shell electrode 306, i.e., a gap between the center electrode and the outer electrode shell. The igniter tip 308 is configured so that a spark gap 310 is on a radially-facing surface 316 of spark igniter 300. Often a semiconductor material is applied to the insulating material at this gap to facilitate sparking. At this spark gap 310, a high-energy spark can pass between a first edge 312 of the center electrode 302 and a second edge 314 of the shell electrode 306. Accordingly, spark igniter 300 produces a radially-directed spark, i.e., a spark directed radially outward and away from the radial-facing surface 316.

Figure 4A:
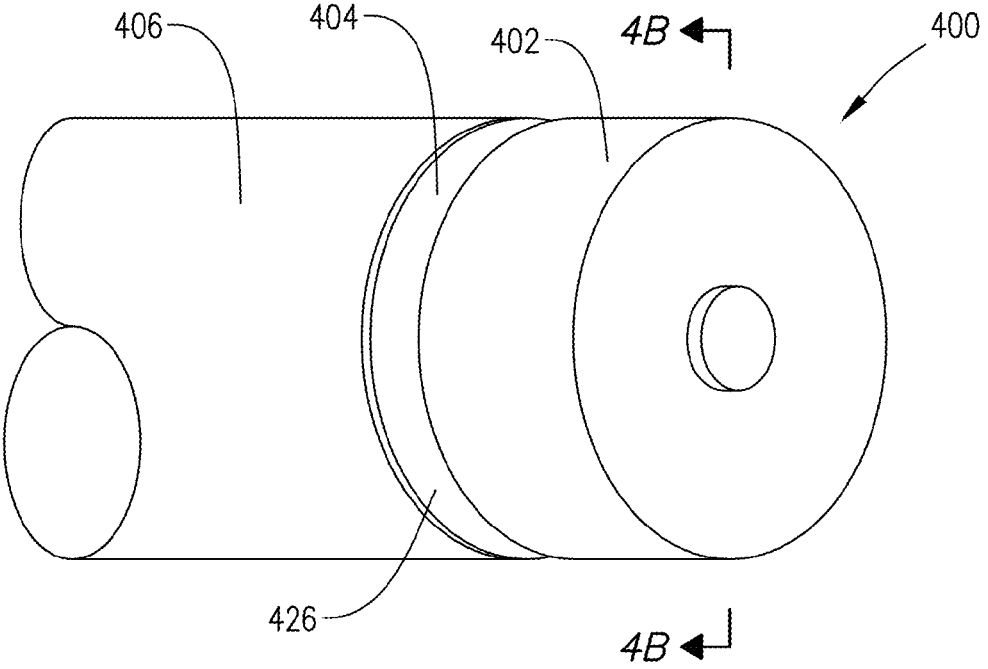
FIG. 4A shows a perspective view of a radially-directed spark igniter that may be used in accordance with certain embodiments of the present disclosure.
Figure 4B:
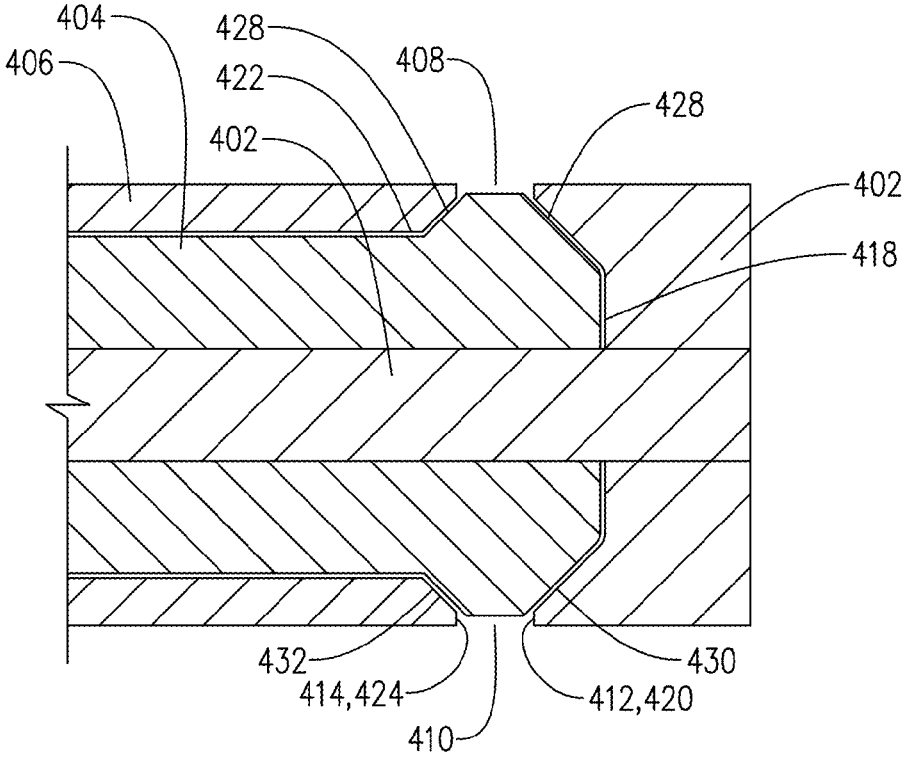
FIG. 4B shows a cross-sectional view of a radially-directed spark igniter that may be used in accordance with certain embodiments of the present disclosure.

FIGS. 4A-B depict a radially-directed spark igniter 400 in accordance with certain embodiments of the current invention. Spark igniter 400 allows an HEI system to minimize its output energy while keeping its output voltage unchanged and continuing to maintain its performance in adverse conditions. Spark igniter 400 has a plurality of electrodes and an insulator 404 that forms a body. The plurality of electrodes comprises a center electrode 402 and a shell electrode 406. The center electrode 402 has an inner surface 418, an end 420 and at least a portion of the center electrode forms at least part of the body's outer surface. The shell electrode 406 also has an inner surface 422, an end 424 and at least a portion of the shell electrode forms at least part of the outer surface of the body. The insulator 404 is between the center electrode 402 and the shell electrode 406 and at least a portion of the insulator is uncovered 426 by the center electrode and the shell electrode such that the center electrode and the shell electrode are positioned and electrically insulated from each other such that a spark gap 410 is formed at the igniter tip 408 from a first edge 412 of the center electrode 402 and a second edge 414 of the shell electrode 406. The depth of the spark gap 410, or in other words well depth, is measured from the uncovered portion 426 of the insulator to the outer surface of the body. The outer surface of the body on a radially-directed igniter is portion of the shell electrode 406 that forms at least part of the outer surface of the body.

FIGS. 4A-B depict an embodiment of the present disclosure that will increase the electric field concentration between the two electrodes by applying internal chamfers to the shell electrode, the center electrode and/or the insulator. As shown in FIG. 4B, a portion of the insulator 404 adjacent to the uncovered portion 426 of the insulator extends to a chamfered portion 428. This chamfered portion 428 mates with a chamfered potion 430 of the inner surface 418 of the center electrode 402 and with a chamfered portion 432 of the inner surface 422 of the shell electrode 406 such that the center electrode 402 and the shell electrode 406 are positioned and electrically insulated from each other such that the spark gap 410 is formed from the first edge 412 of the center electrode 402 and a second edge 414 of the shell electrode 406.

The chamfers shown in FIGS. 4A-B create an electrode profile that contains nearly-sharp edges thereby increasing the electric field concentration between the shell electrode and center electrode. Among other advantages, these chamfers allow for better contact between mating parts and, thus, decrease the chance of a liquid penetrating between mating surfaces.

Another embodiment shown by FIGS. 4A-B increases the electric field concentration between the two electrodes by decreasing the well depth of the igniter tip to produce a flush or "nearly flush" surface gap between the shell electrode, the center electrode and the insulator. This effectively creates an electrode profile (relative to a plane perpendicular to the radial direction) that contains nearly sharp edges. Among other advantages, this limits the total volume of contaminates that may pool or rest upon the air gap of an igniter. To obtain the desired electrode profile for a radially-directed spark igniter the depth must be less than or equal to 8% of the perimeter of the outer surface of the body. As mentioned, the outer surface of the body on a radially-directed igniter is portion of the shell electrode 406 that forms at least part of the outer surface of the body.

Figure 5A:
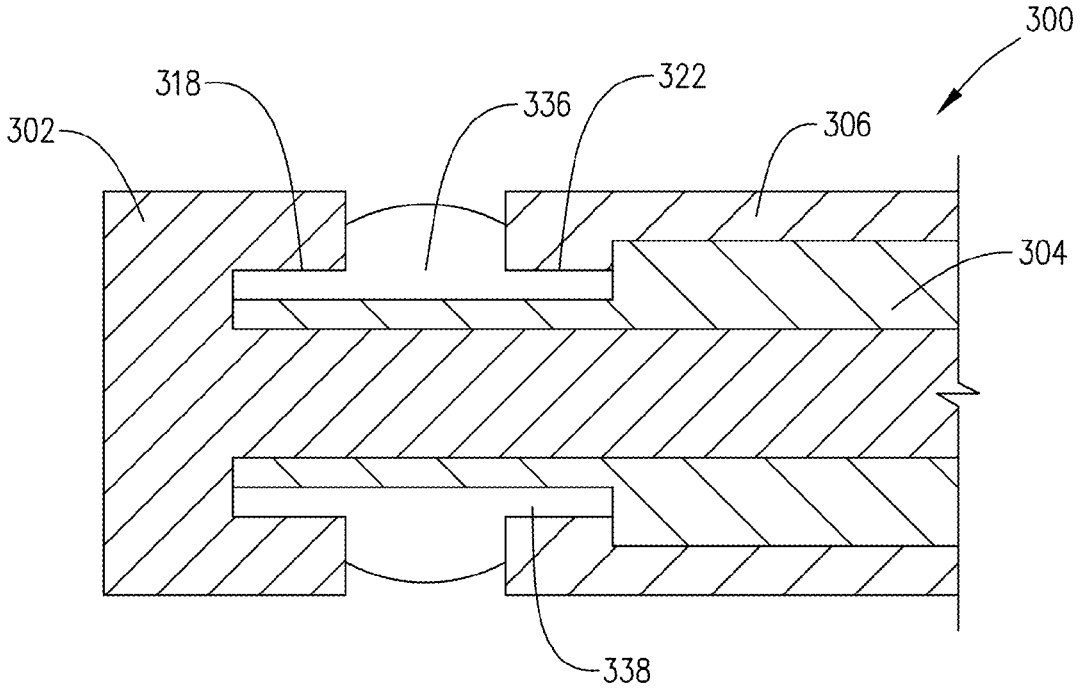
FIG. 5A is a cross-sectional view of a radially-directed spark igniter.

FIG. 5A depicts the radially-directed spark igniter 300. The spark igniter 300 is depicted having exaggerated air gaps 336 between the insulator 304, an inner surface 318 of the center electrode 302 and an inner surface 322 of the shell electrode 306. An air gap is the space between the center electrode and shell electrode. The air gaps 336 are shown exaggerated to demonstrate that contaminates such as water 338 or other debris may pool or rest upon the air gap of an igniter. Ionized water pooling in the igniter well acts as a conductive path through which current can flow. The addition of the water effectively increases the conductive area and therefore decreases the current density. Current density is the electric current per unit area. A higher density increases an igniter's ability to achieve an arc.

Figure 5B:
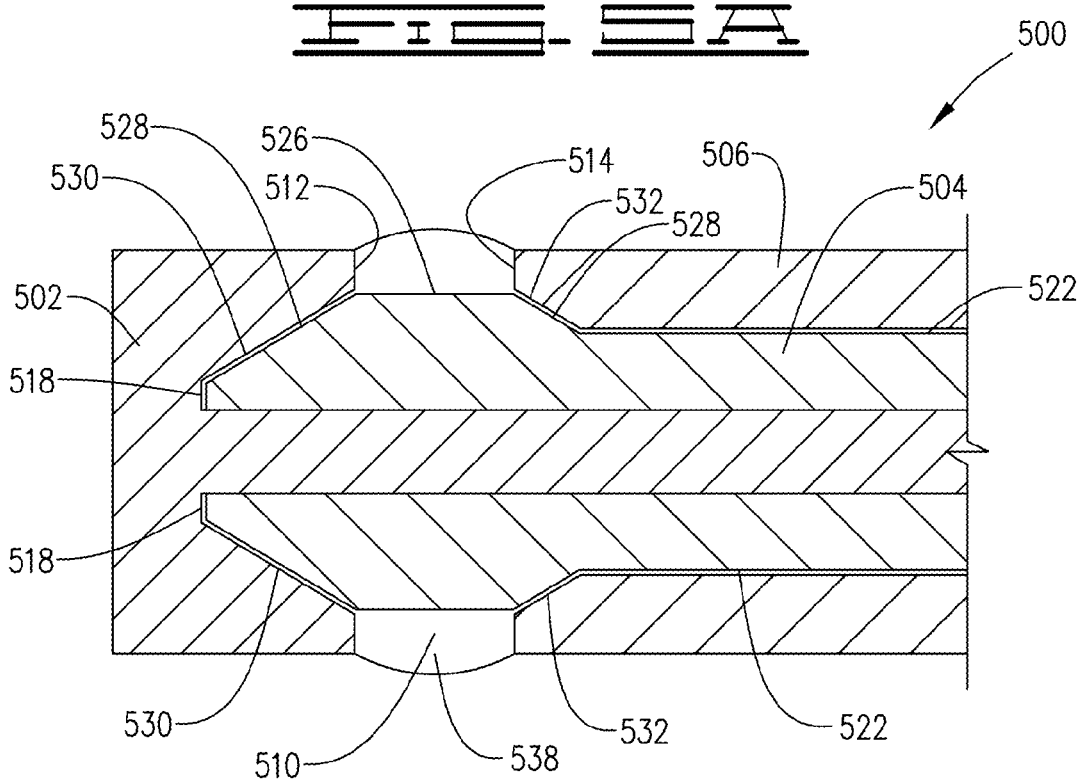
FIG. 5B is a cross-sectional view an embodiment of a radially-directed spark igniter.

By minimizing the amount of water that can pool in an air gap, the deleterious effects the pooled water has on current density can be minimized. FIG. 5B discloses an embodiment of a radially-directed igniter 500 having internal chamfers to a center electrode 502, an insulator 504 and the shell electrode 506. The internal chamfers aid in reducing the area where water 538 or other debris can accumulate. As shown, a portion of the insulator 504 adjacent to an uncovered portion 526 of the insulator extends to chamfered portion 528, which mates with chamfered portion 530 of an inner surface 518 of the center electrode 502 and with chamfered portion 532 of an inner surface 522 of the shell electrode 506 such that center electrode 502 and shell electrode 506 are positioned and electrically insulated from each other such that a spark gap 510 is formed from first edge 512 of the center electrode 502 and second edge 514 of the shell electrode 506.

Figure 6A:
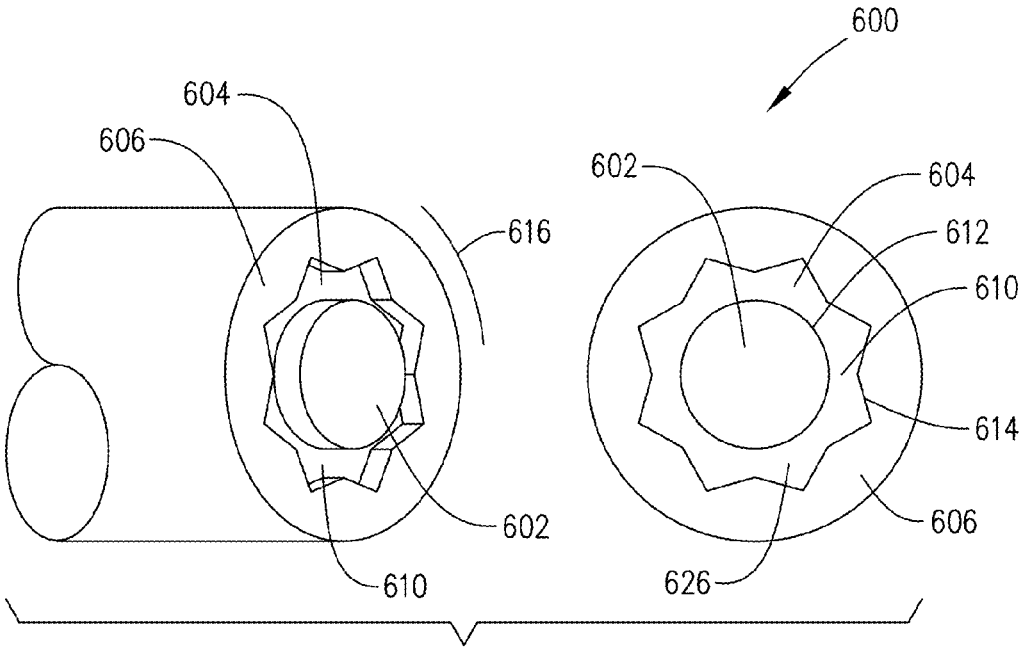
FIG. 6A is a diagram illustrating an example of an axially-directed spark igniter having a non-uniform electrode shell shape in accordance with an embodiment.
Figure 6B:
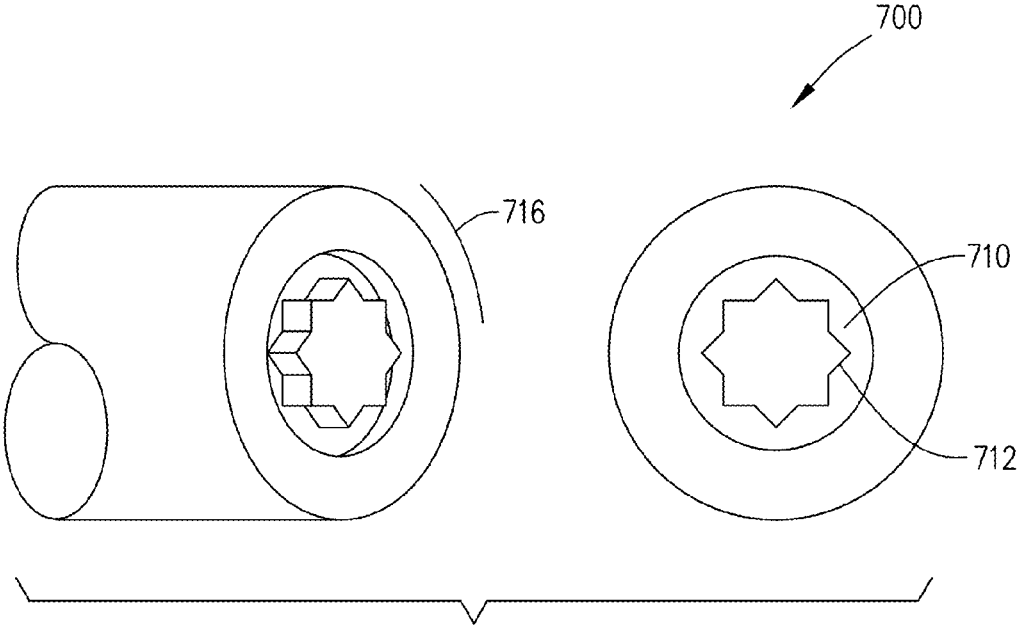
FIG. 6B is a diagram illustrating an example of an axially-directed spark igniter having a non-uniform center electrode shape in accordance with another embodiment.

FIGS. 6A-B depict embodiments of an axially-directed spark igniter having a non-uniform electrode perimeter that effectively creates an electrode profile (relative to a plane perpendicular to the axial direction) that contains nearly sharp edges. In FIG. 6A, the spark igniter 600 comprises a plurality of electrodes and an insulator 604, which are configured to form a body having an outer surface. The plurality of electrodes comprises a center electrode 602 and a shell electrode 606. The insulator 604 is between the center electrode 602 and the shell electrode 606 and at least a portion of the insulator is uncovered 626 by center electrode 602 and shell electrode 606 such that center electrode 602 and shell electrode 606 are positioned and electrically insulated from each other such that a spark gap 610 is formed from a first edge of the center electrode 612 and a second edge of the shell electrode 614.

In FIGS. 6A-B, at least one of the first edge and the second edge of the spark gap has a non-uniform geometric shape. The non-uniform geometric shape can comprises any one from a group consisting of a star, triangle, quadrilateral, pentagon, hexagon, heptagon, octagon, nonagon, and decagon. Not shown, but included herein is where both the first edge and the second edge of the spark gap have non-uniform geometric shapes.

FIG. 6A depicts an embodiment where the spark gap 610 is located on an axial facing portion 616 of the outer surface of the body and only the second edge 614 of the shell electrode has the non-uniform geometric shape and the shape comprises any one as listed above.

Figure 7A:
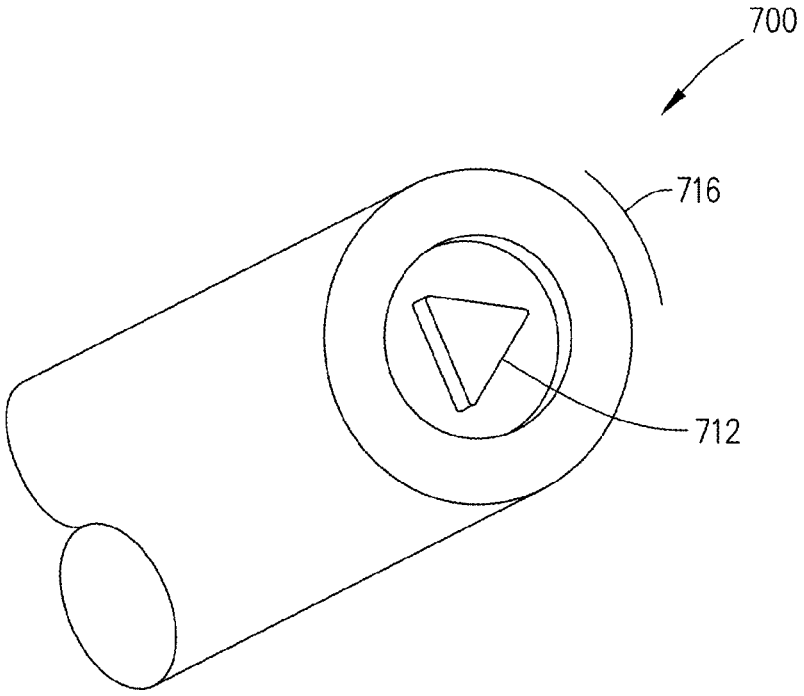
FIGS. 7A-B each illustrates a configuration of an axially-directed spark igniters having non-uniform center electrode shape.
Figure 7B:
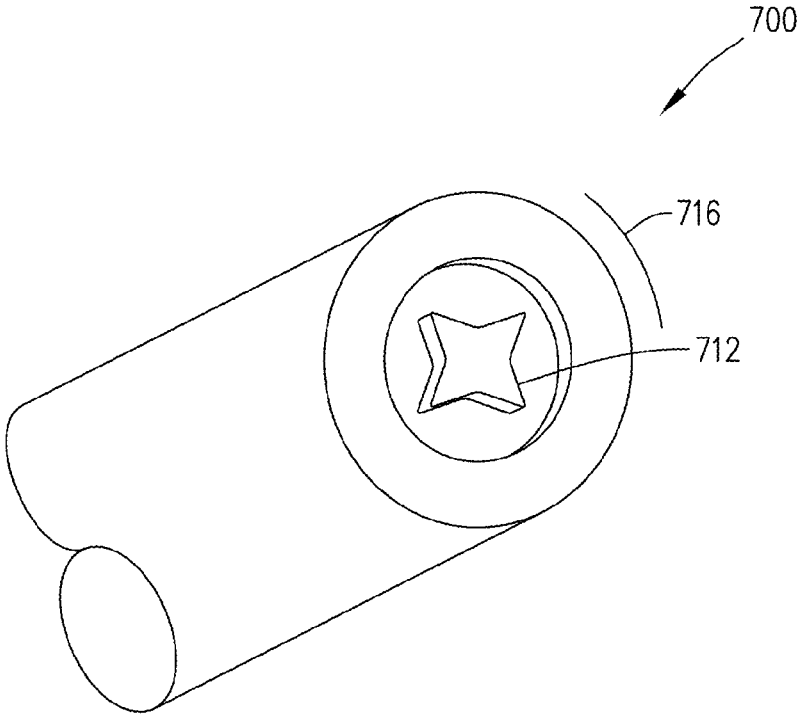

FIGS. 6B-7 show embodiments of an axially-directed spark igniter 700 where the spark gap 710 is located on an axial facing portion 716 of the outer surface of the body and only the first edge 712 of the center electrode has the non-uniform geometric shape and the shape comprises any one as listed above.

Figure 8A:
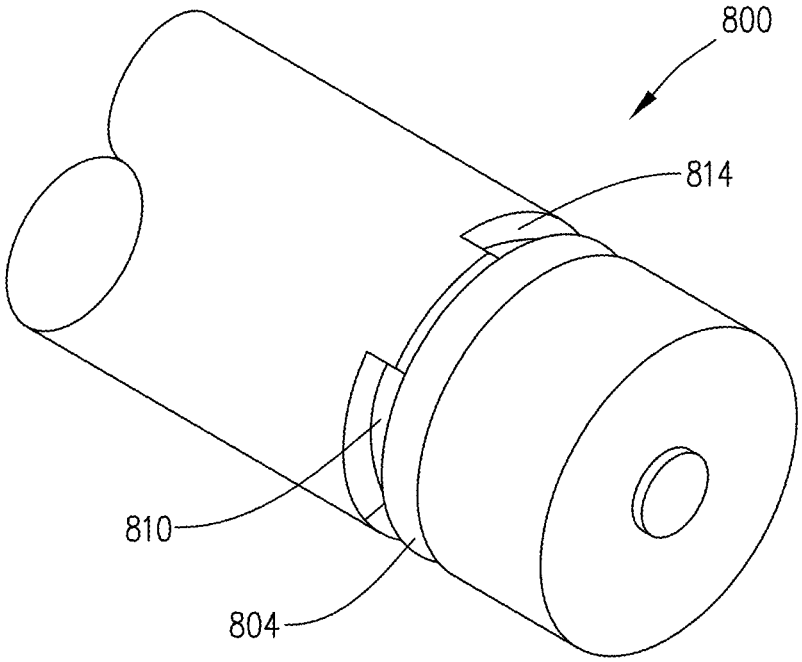
FIG. 8A shows a perspective view of a radially-directed spark igniter having a non-uniform electrode shape.
Figure 8B:
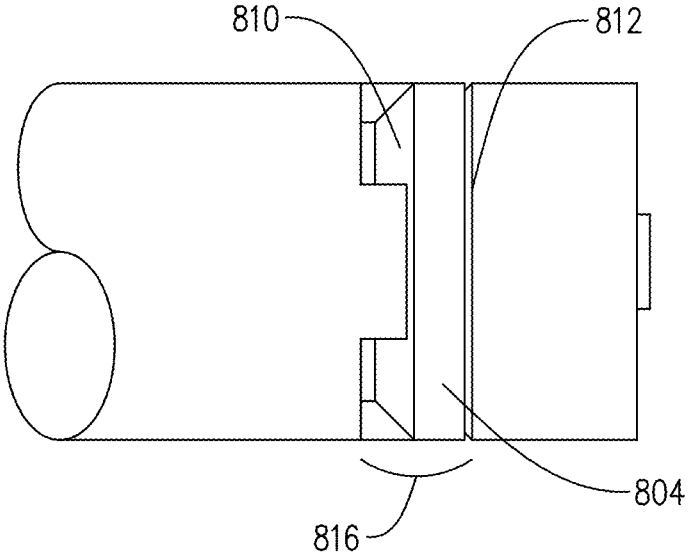
FIG. 8B shows a side view of a radially-directed spark igniter having a non-uniform electrode shape.

FIGS. 8A-B show another embodiment of a radially-directed spark igniter 800 where the spark gap 810 is located on a radial facing portion 816 of the outer surface of the body and the non-uniform shape is such that a portion of the second edge 814 of the shell electrode does not contact the insulator 804. It should be appreciated, though not shown, that a portion of the first edge 812 of the center electrode can be such that it does not contact the insulator 804. In still another embodiment, both the first edge 812 of the center electrode and the second edge 814 of the shell electrode are non-uniform in such a way that a portion of both do not contact the insulator 804.

Figure 9A:
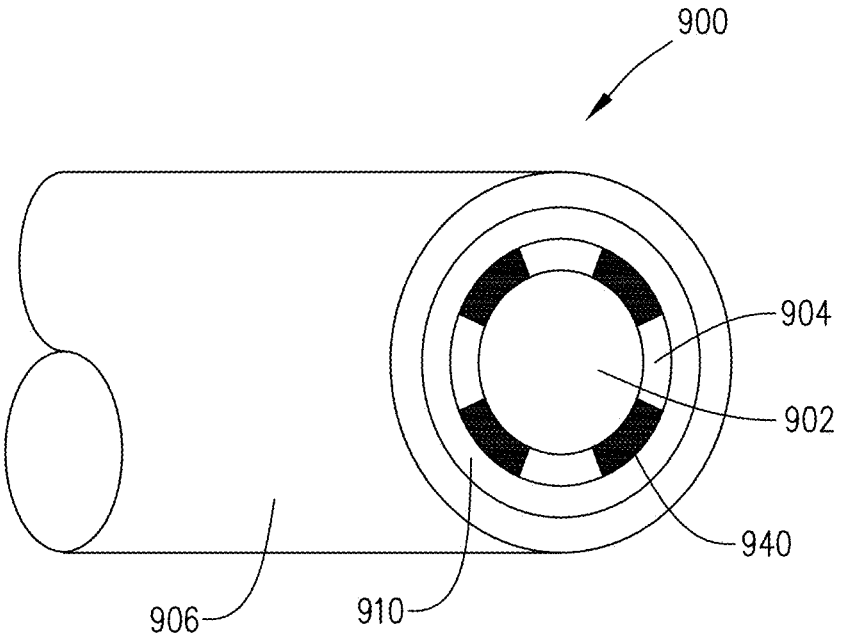
FIG. 9A: is a diagram illustrating an example of an axially-directed spark igniter having a striped or partial semiconductor profile.
Figure 9B:
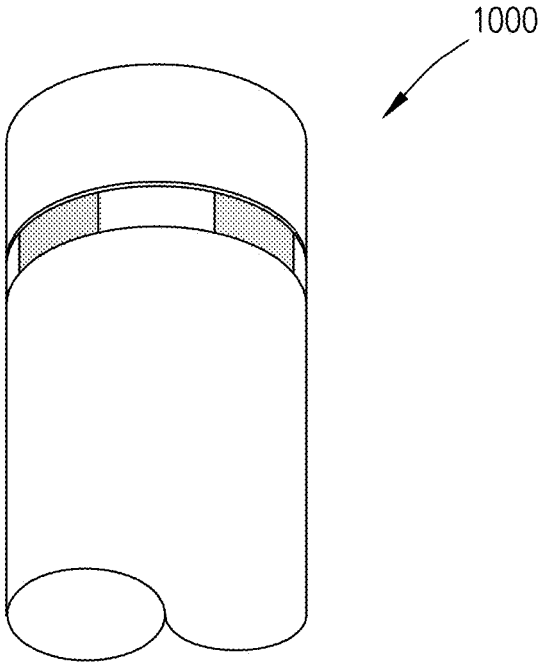
FIG. 9B: is a diagram illustrating an example of a radially-directed spark igniter having a striped or partial semiconductor profile.

Current density across a semiconductor can be increased, when current is held constant, by decreasing the area of the semiconductor. FIG. 9 shows embodiments having a striped or partial semiconductor profile. FIG. 9A shows a striped or partial semiconductor profile on an axially-directed spark igniter 900. As shown, a semiconductor 940 is deposited on the insulator 904 at the bottom of the spark gap 910. The semiconductor 940 forms a conductive path between the center electrode 902 and the shell electrode 906. This semiconductor can be a film applied to the insulator itself. Once the pathway is established, the electrical energy is able to flow unresisted except for circuit impedance, thereby creating a very high current and energy spark at spark gap 910. In addition, FIG. 9B demonstrates that a striped or partial semiconductor profile can also be applied to a radially-directed spark igniter 1000.

In any embodiment disclosed herein, by decreasing the surface area of the semiconductor, the current density across the semiconductor increases thereby increasing the spark igniter's ability to achieve an arc. It should be appreciated that having a striped or partial semiconductor profile can be used as a stand alone modification of the present disclosure or in conjunction with any other embodiment disclosed herein.

EXAMPLE

The following example is provided to illustrate the invention. The example is not intended and should not be taken to limit, modify or define the scope of the present invention in any manner.

Two different ignition exciters and five different igniter tip geometries were tested (refer to Tables 1 and 2 for details related to the tests).

During a first test, a low energy HEI system (~0.33 J) was utilized which could be mated with igniters of approximately ¼ inch diameter. In other words, the igniter OD, defined as the outer diameter (OD) of the shell electrode, is ¼ inch in diameter. During this project three side-firing igniter geometries or radially-directed spark igniters were tested. (See Table 1 for geometry specifications.) Table 1 reflects the results of various experiments carried out with side-fire designs. The results demonstrate that by decreasing the well depth and having chamfered electrodes and insulators, the electric field concentration between the electrodes increases. Increasing the electric field concentration increases the ability to achieve an arc, indicated by a successful spark test.

TABLE 1

| Development Project #1 Data | | | | | | |
|---|---|---|---|---|---|---|
| Test | Igniter Geometry | Igniter OD (inches) | Igniter Gap Width (inches) | Well Depth (inches) | Exciter Output Energy (Joules) | Successful Spark Test? |
| #1 | Non-flush<br>No internal chamfers<br>Side-fired<br>(FIG. 3) | 0.25 | 0.04 | 0.04 | 0.33 | No |
| | Flush gap<br>Chamfered<br>Side-fired<br>(FIG. 4) | 0.25 | 0.04 | 0.002 | 0.33 | Yes |
| | Flush gap<br>Chamfered<br>Side-fired<br>(Similar to FIG. 4) | 0.25 | 0.06-0.08 | 0.002 | 0.33 | No |
| | Flush gap<br>Chamfered<br>Side-fired<br>Semiconductor striped<br>(Similar to FIG. 4) | 0.25 | 0.06-0.08 | 0.002 | 0.33 | Yes |

During a second test, a low energy HEI system (~1.5 J) was utilized that could be mated with igniters of approximately ½ inch diameter. In other words, the igniter OD, defined as the outer diameter (OD) of the shell electrode, is ½ inch in diameter. During this time end-fired igniter tips or axially-directed spark igniters with a focus on keeping the air gap as flush as possible were designed. (See Table 2 for geometry specifications.) Table 2 reflects the results of various experiments carried out with end-fired designs.

As shown, similar results occurred in Table 2, as concurred with the radially-directed spark igniters tested in Table 1. The results demonstrate that by decreasing the well depth and having chamfered electrodes and insulators, the electric field concentration between the electrodes increases. By increasing the electric field concentration, the ability to achieve an arc increases, this is indicated by a successful spark test.

In addition, Table 2 demonstrates that non-uniform electrode profiles, specifically where the center electrode on an axially-directed spark igniter is non-uniform, creates an increase of the electric field concentration between the center and shell electrode thereby increasing the chance of successful spark in adverse conditions.

TABLE 2

| Development Project #2 Data | | | | | | |
|---|---|---|---|---|---|---|
| Test | Igniter Geometry | Igniter OD (inches) | Igniter Gap Width (inches) | Well Depth (inches) | Exciter Output Energy (Joules) | Successful Spark Test, Pouring Water? |
| #2 | Non-flush<br>No internal chamfers<br>End-fired<br>(FIG. 1) | 0.50 | 0.04 | 0.04 | 1.5 | No |
| | Flush<br>Chamfered<br>End-fired<br>(FIG. 2) | 0.47<br>(12 mm) | 0.04 | 0.02 | 1.5 | Yes |
| | Non-flush<br>No internal chamfers<br>End-fired<br>(FIG. 1) | 0.5 | 0.04 | 0.04 | 1.5 | No |
| | Non-flush<br>No internal chamfers<br>End-fired<br>Pointed Electrode<br>(FIG. 7B) | 0.5 | 0.04 | 0.04 | 1.5 | Yes |
| | Non-flush<br>No internal chamfers<br>End-fired<br>Pointed Electrode<br>(FIG. 7A) | 0.5 | 0.04 | 0.04 | 1.5 | Yes |
| | Non-flush<br>No internal chamfers<br>End-fired<br>(FIG. 1) | 0.625 | 0.06 | 0.125 | 1.5 | No |

TABLE 2-continued

| Development Project #2 Data | | | | | | |
|---|---|---|---|---|---|---|
| Test | Igniter Geometry | Igniter OD (inches) | Igniter Gap Width (inches) | Well Depth (inches) | Exciter Output Energy (Joules) | Successful Spark Test, Pouring Water? |
| | Non-flush<br>No internal chamfers<br>End-fired<br>Pointed Electrode<br>(FIG. 7B) | 0.625 | 0.06 | 0.125 | 1.5 | Yes |

The invention claimed is:

1. A spark igniter comprising:

a plurality of electrodes and an insulator, which are configured to form a body having an outer surface;

the plurality of electrodes comprises:

a center electrode having an inner surface and an end, wherein at least a portion of the center electrode forms at least part of the outer surface of the body; and a shell electrode having an inner surface and an end, wherein at least a portion of the shell electrode forms at least part of the outer surface of the body;

wherein the insulator is between the center electrode and the shell electrode and at least a portion of the insulator is uncovered by the center electrode and the shell electrode;

wherein a chamfered portion of the insulator is adjacent to the uncovered portion of the insulator, and the chamfered portion mates with a chamfered portion of the inner surface of the center electrode and with a chamfered portion of the inner surface of the shell electrode such that the center electrode and the shell electrode are positioned and electrically insulated from each other such that a spark gap is formed from a first edge of the center electrode and a second edge of the shell electrode, and wherein a depth of the spark gap is measured from the uncovered portion of the insulator to the outer surface of the body and wherein the depth is less than 8% of the outer surface perimeter of the body.

2. The spark igniter of claim 1, wherein the depth of the spark gap is from 0.25% to 6.4% of the outer surface perimeter of the body.

3. The spark igniter of claim 1, wherein a depth of the spark gap is measured from the uncovered portion of the insulator to the outer surface of the body and wherein the depth is less than or equal to 5% of the perimeter of the inner surface of the shell electrode measured at the second edge.

4. The spark igniter of claim 1, wherein the spark gap is located on an axial facing surface.

5. The spark igniter of claim 1, wherein the spark gap is located on a radial facing surface.

6. The spark igniter of claim 1, wherein a semiconductor material is applied to the uncovered portion of the insulator such that said semiconductor has a non-uniform coverage of the uncovered portion of the insulator.

7. The spark igniter of claim 6, wherein the semiconductor material is applied in stripes such that at least an area of the uncovered portion of the insulator is without a semiconductor material.

8. The spark igniter of claim 1, wherein at least one of the first edge and the second edge has a non-uniform geometric shape.

9. The spark igniter of claim 8, wherein at least one of the first edge and the second edge has a non-uniform geometric shape comprising any one from a group consisting of a star, triangle, quadrilateral, pentagon, hexagon, heptagon, octagon, nonagon, and decagon.

10. The spark igniter of claim 1, wherein at least one of the ends forms at least one of the first edge and the second edge of the spark gap and wherein at least a portion of at least one end does not contact the insulator.

11. A spark igniter comprising:

a plurality of electrodes and an insulator, which are configured to form a body having an outer surface;

the plurality of electrodes comprises:

a center electrode having an inner surface and an end, wherein at least a portion of the center electrode forms at least part of the outer surface of the body; and a shell electrode having an inner surface and an end, wherein at least a portion of the shell electrode forms at least part of the outer surface of the body;

wherein the insulator is between the center electrode and the shell electrode and at least a portion of the insulator is uncovered by the center electrode and the shell electrode such that the center electrode and the shell electrode are positioned and electrically insulated from each other such that a spark gap is formed on the outer surface of the body from a first edge of the center electrode and a second edge of the shell electrode and the spark gap is located on an axial facing portion of the outer surface; and wherein the second edge has a non-uniform geometric shape comprising any one from a group consisting of a star, triangle, quadrilateral, pentagon, hexagon, heptagon, octagon, nonagon, and decagon.

12. The spark igniter of claim 11, wherein a depth of the spark gap is measured from the uncovered portion of the insulator to the outer surface of the body and wherein the depth is less than 8% of the outer surface perimeter of the body.

13. The spark igniter of claim 11, wherein a depth of the spark gap is measured from the uncovered portion of the insulator to the outer surface of the body and wherein the depth is less than or equal to 5% of the perimeter of the inner surface of the shell electrode measured at the second edge.

14. A spark igniter comprising:

a plurality of electrodes and an insulator, which are configured to form a body having an outer surface;

the plurality of electrodes comprises:

a center electrode having an inner surface and an end, wherein at least a portion of the center electrode forms at least part of the outer surface of the body; and a shell electrode having an inner surface and an end, wherein at least a portion of the shell electrode forms at least part of the outer surface of the body;

wherein the insulator is positioned between the center electrode and the shell electrode, wherein at least a portion of the insulator is uncovered by the center electrode and the shell electrode such that a spark gap is formed from a first edge of the center electrode and a second edge of the shell electrode;

wherein the depth of the spark gap is measured from the uncovered portion of the insulator to the outer surface of the body and wherein the depth is less than 8% of the outer surface perimeter of the body.

15. The spark igniter of claim 14, wherein the depth is less than or equal to 5% of the perimeter of the inner surface of the shell electrode measured at the second edge.

16. The spark igniter of claim 14, wherein a portion of insulator adjacent to the uncovered portion of the insulator extends to a chamfered portion, which mates with a chamfered portion of the inner surface of the center electrode and with a chamfered portion of the inner surface of the shell electrode.

17. The spark igniter of claim 14, wherein a semiconductor material is applied to the uncovered portion of the insulator such that said semiconductor has a non-uniform coverage of the uncovered portion of the insulator.

18. The spark igniter of claim 17, wherein the semiconductor material is applied in stripes such that at least an area of the uncovered portion of the insulator is without a semiconductor material.

19. The spark igniter of claim 14, wherein the depth of the spark gap is from 0.25% to 6.4% of the outer surface perimeter of the body.

* * * * *